US008593121B2

(12) United States Patent
Li et al.

(10) Patent No.: US 8,593,121 B2
(45) Date of Patent: Nov. 26, 2013

(54) CIRCUIT AND METHOD FOR VOLTAGE REGULATOR OUTPUT VOLTAGE TRIMMING

(75) Inventors: Yike Li, Chengdu (CN); Jiangyun Zhou, Chengdu (CN)

(73) Assignee: Chengdu Monolithic Power Systems Co., Ltd., Chengdu, Sichuan (CN)

( * ) Notice: Subject to any disclaimer, the term of this patent is extended or adjusted under 35 U.S.C. 154(b) by 214 days.

(21) Appl. No.: 13/282,744

(22) Filed: Oct. 27, 2011

(65) Prior Publication Data

US 2012/0112725 A1 May 10, 2012

(30) Foreign Application Priority Data

Nov. 5, 2010 (CN) ..... 2010 1 0533723

(51) Int. Cl.
*G05F 1/00* (2006.01)
*G05F 1/12* (2006.01)

(52) U.S. Cl.
USPC ..... 323/282; 323/280; 323/281; 323/284; 323/297

(58) Field of Classification Search
USPC ..... 323/222–226, 271–277, 280–286, 297
See application file for complete search history.

(56) References Cited

U.S. PATENT DOCUMENTS

| | | | | |
|---|---|---|---|---|
| 2,863,118 | A * | 12/1958 | Pihl | 324/123 R |
| 5,907,237 | A * | 5/1999 | Sekimoto | 323/282 |
| 5,917,311 | A * | 6/1999 | Brokaw | 323/280 |
| 7,346,088 | B2 * | 3/2008 | Chen | 372/38.01 |
| 7,541,787 | B2 * | 6/2009 | Hayashi et al. | 323/281 |
| 7,880,452 | B1 * | 2/2011 | Prasad et al. | 323/282 |
| 2001/0011886 | A1 * | 8/2001 | Kobayashi | 323/281 |
| 2003/0128560 | A1 * | 7/2003 | Saiki et al. | 363/65 |
| 2004/0245977 | A1 * | 12/2004 | Tran | 323/315 |
| 2006/0119341 | A1 * | 6/2006 | Budak et al. | 324/76.11 |
| 2007/0075825 | A1 * | 4/2007 | Kato | 338/195 |
| 2007/0296384 | A1 * | 12/2007 | Dow et al. | 323/284 |
| 2009/0243571 | A1 * | 10/2009 | Cook et al. | 323/280 |

* cited by examiner

*Primary Examiner* — Timothy J Dole
*Assistant Examiner* — Yusef Ahmed
(74) *Attorney, Agent, or Firm* — Perkins Coie LLP

(57) ABSTRACT

The present disclosure discloses a voltage regulator including a trimming circuit. The present disclosure also discloses a method for trimming an output voltage of a voltage regulator. In one embodiment the voltage regulator may include a power conversion module, a feedback and trimming module and a control module. The voltage regulator may be able to provide an output voltage that could be regulated to a plurality of output values, the feedback and trimming module may be able to trim the plurality of output values to their desired values successively and independently.

18 Claims, 5 Drawing Sheets

CIRCUIT AND METHOD FOR VOLTAGE REGULATOR OUTPUT VOLTAGE TRIMMING

CROSS-REFERENCE TO RELATED APPLICATION(S)

This application claims priority to and the benefit of Chinese Patent Application No. 201010533723.X, filed Nov. 5, 2010, which is incorporated herein by reference in its entirety.

TECHNICAL FIELD

This disclosure relates generally to voltage regulators, and particularly relates to apparatus and method for trimming an output voltage of a voltage regulator.

BACKGROUND

The statements in this section merely provide background information related to the present invention and may not constitute prior art.

Voltage regulators are widely used as power supplies for various electrical/electronic devices. Generally, a voltage regulator employs negative feedback regulation for regulating its output voltage at a desired value. In some applications, it is desired that the voltage regulator provides an output voltage having a plurality of different regulated values, for example, when the voltage regulator is used for linearly charging a plurality of batteries.

FIG. 1 illustrates schematically a voltage regulator 100 comprising: a power conversion module 101, a control module 103, and a feedback module 105, wherein the power conversion module 101 is configured to receive an input voltage $V_{in}$ and to provide an output voltage $V_{out}$; and wherein the feedback module 105 is configured to receive the output voltage $V_{out}$ and to provide a feedback signal $V_{fb}$ that is related to the output voltage $V_{out}$ to the control module 103; and wherein the control module 103 is configured to receive on the one hand the feedback signal $V_{fb}$, and on the other hand a reference signal $V_{ref}$, and to provide a control signal $V_C$ based on an error between the feedback signal $V_{fb}$ and the reference signal $V_{ref}$ to the power conversion module 101 to regulate the power conversion module 101 to convert the input voltage $V_{in}$ into the output voltage $V_{out}$.

Theoretically, the output voltage $V_{out}$ of the voltage regulator 100 may be configured to have a plurality of different regulated output values either by setting the reference signal $V_{ref}$ to have a plurality of different reference values corresponding to the plurality of different regulated output values, or by setting the feedback module 105 to monitor the output voltage $V_{out}$ at a plurality of different feedback points so that the feedback signal $V_{fb}$ has a plurality of different feedback values corresponding to the plurality of different regulated output values. However, if one or more of the plurality of regulated output values are relatively small, the corresponding reference value/values may be too small to accurately generate. Thus, in practical, the output voltage $V_{out}$ is configured to have a plurality of different regulated output values generally by setting the feedback module 105 to monitor the output voltage $V_{out}$ at a plurality of different feedback points.

FIG. 2 illustrates schematically a voltage regulator 200 capable of providing an output voltage $V_{out}$ having two different regulated output values $V_{out1}$ and $V_{out2}$. Components or structures in the voltage regulator 200 with substantially the same functions as those of the voltage regulator 100 are identified by the same reference labels as used in the voltage regulator 100 for the sake of simplicity. The feedback module 105 exemplarily comprises a first feedback resistor $R_1$, a second feedback resistor $R_2$, and a third feedback resistor $R_3$ coupled in order and in series between the output voltage $V_{out}$ and ground, wherein the connection between the first feedback resistor $R_1$ and the second feedback resistor $R_2$ forms a first feedback point $FB_1$, and wherein the connection between the second resistor $R_2$ and the third feedback resistor $R_3$ forms a second feedback point $FB_2$. When the feedback module 105 provides the feedback signal $V_{fb}$ from the first feedback point $FB_1$, the feedback signal $V_{fb}$ has a first feedback value $V_{fb1}$. In this case, the output voltage $V_{out}$ is regulated at a first output value $V_{out1}$ based on a difference between the first feedback value $V_{fb1}$ and the reference signal $V_{ref}$. When the feedback module 105 provides the feedback signal $V_{fb}$ from the second feedback point $FB_2$, the feedback signal $V_{fb}$ has a second feedback value $V_{fb2}$. In this case, the output voltage $V_{out}$ is regulated at a second output value $V_{out2}$ based on a difference between the second feedback value $V_{fb2}$ and the reference signal $V_{ref}$. The first regulated output value $V_{out1}$ and the second regulated output value $V_{out2}$ may respectively be expressed as follows:

$$Vout_1 = \frac{(R_1 + R_2 + R_3)Vref}{R_1} \quad (1)$$

$$Vout_2 = \frac{(R_1 + R_2 + R_3)Vref}{R_1 + R_2} \quad (2)$$

Usually, due to the influences from process, temperature and parasitic parameters etc., the output values of the output voltage $V_{out}$ may deviate from their desired values. For the voltage regulator illustrated in FIG. 2, supposing that both the first output value $V_{out1}$ and the second output value $V_{out2}$ are deviated from their desired values, for example, lower than their desired values, generally trimming may be applied to the first feedback resistor $R_1$ to correct the first output value $V_{out1}$, the second feedback resistor $R_2$ and the third feedback resistor $R_3$ to correct the second output value $V_{out2}$. On one hand, according to the expression (2), we may firstly trim the third feedback resistor $R_3$ to have its resistance increased while keep the first feedback resistor $R_1$ and the second feedback resistor $R_2$ unchanged such that the second output value $V_{out2}$ is increased to its desired value; on the other hand, according to the expression (1), increasing the resistance of $R_2$+$R_3$ while keeping $R_1$ unchanged may help to increase the first output value $V_{out1}$ to its desired value, however, since $R_3$ has already been appropriately trimmed to have the second output value $V_{out2}$ reach its desired value, we may just trim $R_2$ to increase the resistance of $R_2$+$R_3$ to have the first output value $V_{out1}$ reach its desired value. But referring to the expression (2) again, when the second feedback resistor $R_2$ is trimmed, the second output value $V_{out2}$ may deviate from its desired value again, needing to trim $R_3$ again. Nevertheless, through such repeat trimming to the second feedback resistor $R_2$ and the third feedback resistor $R_3$, it is still hard to obtain satisfied trimming results for the first output value $V_{out1}$ and the second output value $V_{out2}$.

To resolve the above mentioned problem, an alternative voltage regulator 300 as illustrated in FIG. 3 may be provided, wherein the feedback module 105 may comprise a first resistor divider comprising a first feedback resistor $R_1$ and a second feedback resistor $R_2$ coupled in series between the output voltage $V_{out}$ and ground, and a second resistor divider comprising a third feedback resistor $R_3$ and a fourth feedback resistor $R_4$ coupled in series between the output voltage $V_{out}$ and ground. In this configuration, the connection between the first feedback resistor $R_1$ and $R_2$ forms the first feedback point $FB_1$, and the connection between the third feedback resistor $R_3$ and the fourth feedback resistor $R_4$ forms the second feedback point $FB_2$. The first output value $V_{out1}$ and the second output value $V_{out2}$ may be expressed as follows:

$$Vout_1 = \frac{(R_1 + R_2)Vref}{R_1} \quad (3)$$

$$Vout_2 = \frac{(R_3 + R_4)Vref}{R_3} \quad (4)$$

In this case, still supposing that both the first output value $V_{out1}$ and the second output value $V_{out2}$ are deviated from their desired values, we may respectively trim the second feedback resistor $R_2$ and the fourth feedback resistor $R_4$ for respectively trimming the first output value $V_{out1}$ and the second output value $V_{out2}$ to their desired values. However, the using of two separate resistor dividers to provide the first feedback value $V_{fb1}$ and the second feedback value $V_{fb2}$ respectively corresponding to the first output value $V_{out1}$ and the second output value $V_{out2}$ simplifies the trimming for the output values $V_{out1}$ and $V_{out2}$ at the expense of increasing the power loss and chip size of the voltage regulator. This disadvantage becomes more obvious when more than two different output values are desired.

SUMMARY

In accordance with one embodiment, a voltage regulator comprises: a power conversion module configured to receive an input voltage, and to convert the input voltage into an output voltage configurable to be regulated to a plurality of output values indexed from 1 to N, wherein N is a positive integer; a feedback and trimming module comprising a plurality of voltage dividing devices coupled in series between the output voltage and ground, wherein the feedback and trimming module is configured to provide a plurality of feedback terminals indexed from 1 to N leading out from N different positions on the plurality of voltage dividing devices, and wherein the plurality of feedback terminals indexed from 1 to N are configured to provide a plurality of feedback voltages indexed from 1 to N respectively corresponding to the plurality of output values indexed from 1 to N; and a control module configured to selectively receive one of the plurality of feedback voltages indexed by X a time, and to compare the received feedback voltage indexed by X with a reference signal to provide a control signal to the power conversion module, wherein the control signal represents an error between the received feedback voltage indexed by X and the reference signal, and wherein the power conversion module regulates the output voltage to the output value indexed by X corresponding to the received feedback voltage indexed by X in response to the control signal, and wherein X changes from 1 to N; and wherein the feedback and trimming module is further configured to successively trim the leading out positions of the plurality of feedback terminals indexed from 1 to N on the plurality of voltage dividing devices so as to successively trim the plurality of output values indexed from 1 to N to their desired values independently.

In accordance with one embodiment, a trimming circuit comprises: an input terminal configured to receive an output voltage of a voltage regulator configurable to be regulated to a plurality of output values indexed from 1 to N, wherein N is a positive integer; a plurality of feedback terminals indexed from 1 to N configured to provide a plurality of feedback voltages indexed from 1 to N corresponding to the plurality of output values indexed from 1 to N; and a plurality of voltage dividing devices coupled in series between the input terminal and ground, wherein the plurality of feedback terminals indexed from 1 to N are provided from N different leading out positions on the plurality of voltage dividing devices, and wherein the plurality of output values indexed from 1 to N corresponding to the plurality of feedback voltages indexed from 1 to N are successively and independently trimmed to their desired values via successively trimming the leading out positions of the plurality of feedback terminals indexed from 1 to N on the plurality of voltage dividing devices.

In accordance with one embodiment, a method for trimming an output voltage of a voltage regulator, comprises: coupling a plurality of voltage dividing devices in series between the output voltage and ground; providing a plurality of feedback terminals indexed from 1 to N leading out from N different positions on the plurality of voltage dividing devices, wherein N is a positive integer, and wherein the plurality of feedback terminals having a plurality of feedback voltages indexed from 1 to N respectively corresponding to a plurality of output values indexed from 1 to N of the output voltage; and trimming the leading out positions of the plurality of feedback terminals indexed from 1 to N on the plurality of voltage dividing devices successively so as to trim the plurality of output values indexed from 1 to N successively and independently.

BRIEF DESCRIPTION OF THE DRAWINGS

The following detailed description of the embodiments of the present invention can best be understood when read in conjunction with the following drawings, in which the features are not necessarily drawn to scale but rather are drawn as to best illustrate the pertinent features.

DETAILED DESCRIPTION

Various embodiments of the present invention will now be described. In the following description, some specific details, such as example circuits and example values for these circuit components, are included to provide a thorough understanding of the embodiments. One skilled in the relevant art will recognize, however, that the present invention can be practiced without one or more specific details, or with other methods, components, materials, etc. In other instances, wellknown structures, materials, processes or operations are not shown or described in detail to avoid obscuring aspects of the present invention.

Figure 1:
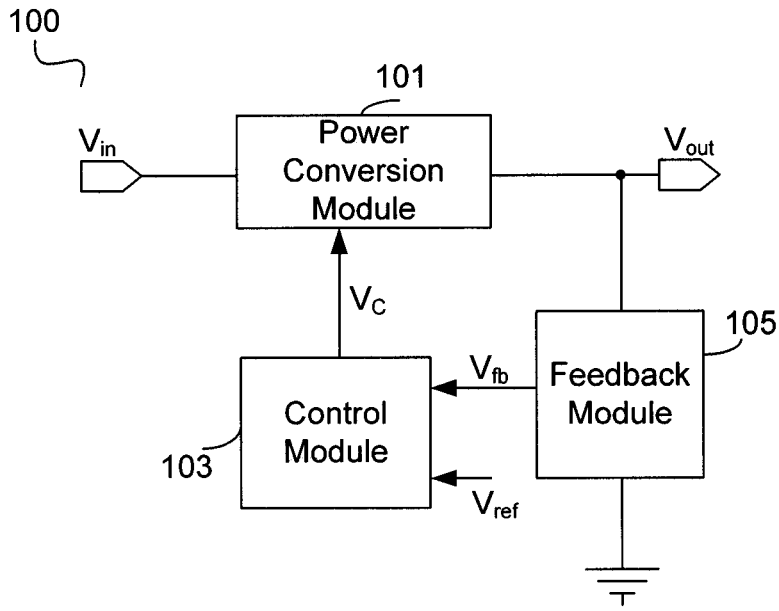
FIG. 1 illustrates schematically a voltage regulator 100.
Figure 2:
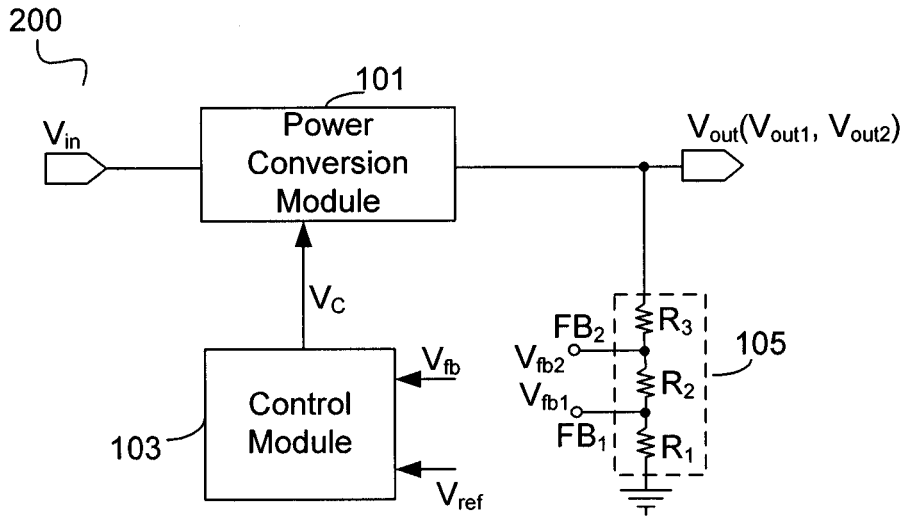
FIG. 2 illustrates schematically a voltage regulator 200 capable of providing an output voltage having two different regulated output values.
Figure 3:
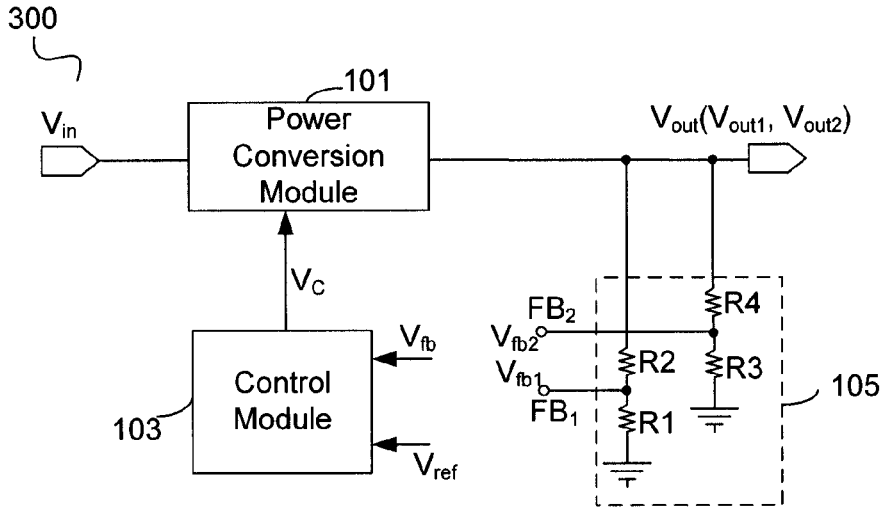
FIG. 3 illustrates schematically another voltage regulator 300 capable of providing an output voltage $V_{out}$ having two different regulated output values.
Figure 4:
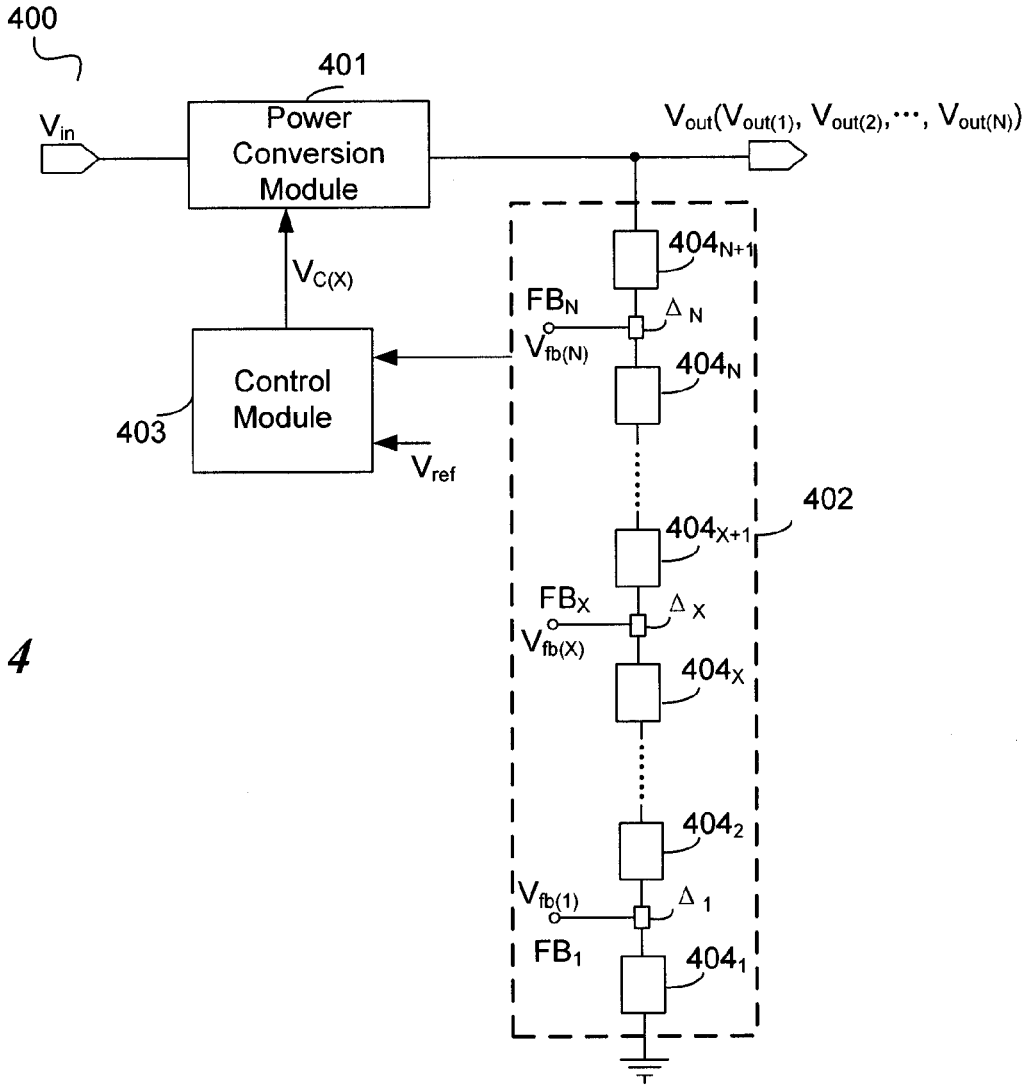
FIG. 4 illustrates schematically a voltage regulator 400 in accordance with one embodiment of the present invention.

FIG. 4 illustrates schematically a voltage regulator 400 in accordance with an embodiment of the present invention. The voltage regulator 400 comprises a power conversion module 401 configured to receive an input voltage $V_{in}$, and to convert the input voltage $V_{in}$ into an output voltage $V_{out}$ configurable to be regulated to a plurality of output values $V_{out(1)}$~$V_{out(N)}$, wherein N is a positive integer; a feedback and trimming module 402 comprising a plurality of voltage dividing devices coupled in series between the output voltage $V_{out}$ and ground, wherein the feedback and trimming module 402 is configured to provide a plurality of feedback terminals $FB_1$~$FB_N$ leading out from a plurality of different positions on the plurality of voltage dividing devices, and wherein the plurality of feedback terminals $FB_1$~$FB_N$ are respectively configured to provide a plurality of feedback voltages $V_{fb(1)}$~$V_{fb(N)}$ respectively corresponding to the plurality of output values $V_{out(1)}$~$V_{out(N)}$; and a control module 403 configured to selectively receive one of the plurality of feedback voltages $V_{fb(1)}$~$V_{fb(N)}$ identified by $V_{fb(X)}$, and to compare the received feedback voltage $V_{fb(X)}$ with a reference signal $V_{ref}$ to provide a control signal $V_{C(X)}$ to the power conversion module 401, wherein the control signal $V_{C(X)}$ represents an error between the feedback voltage $V_{fb(X)}$ and the reference signal $V_{ref}$, and wherein the power conversion module 401 regulates the output voltage $V_{out}$ to the output value $V_{out(X)}$ in response to the control signal $V_{C(X)}$, and wherein X may change from 1 to N. In this way, the voltage regulator 400 may be able to convert the input voltage $V_{in}$ into the output voltage $V_{out}$ configurable to have a plurality of output values $V_{out(1)}$~$V_{out(N)}$ via negative feedback regulation. The output voltage $V_{out}$ is regulated to which one of the plurality of output values $V_{out(1)}$~$V_{out(N)}$ depends on which one of the plurality of feedback signals $V_{fb(1)}$~$_{fb(N)}$ is provided to the control module 403 to compare with the reference signal $V_{ref}$.

In accordance with the exemplary embodiment shown in FIG. 4, when the plurality of output values $V_{out(1)}$~$V_{out(N)}$ are deviated from their desired values, the feedback and trimming module 402 may be configured to successively trim the leading out positions of the plurality of feedback terminals $FB_1$~$FB_N$ on the plurality of voltage dividing devices so as to successively trim the plurality of feedback voltages $V_{fb(1)}$~$V_{fb(N)}$ such that the plurality of output values $V_{out(1)}$•$V_{out(N)}$ are correspondingly successively trimmed to their desired values. In this way, the trimming for two successive feedback voltages $V_{fb(X)}$ and $V_{fb(X+1)}$ is independent, and thus the trimming for two successive output values $V_{out(X)}$ and $V_{out(X+1)}$ is independent, wherein X may change from 1 to (N−1). That is to say, the plurality of output values $V_{out(1)}$~$V_{out(N)}$ corresponding to the plurality of feedback voltages $V_{fb(1)}$~$V_{fb(N)}$ are successively trimmed to their desired values via successively trimming the leading out positions of the plurality of feedback terminals $FB_1$~$FB_N$ on the plurality of voltage dividing devices; and the trimming for the plurality of output values $V_{out(1)}$~$V_{out(N)}$ is independent.

In one embodiment, the feedback and trimming module 402 may comprise a group of resistive voltage dividing devices $\mathbf{404}_1$~$\mathbf{404}_{N+1}$ coupled in series between the output voltage $V_{out}$ and ground with a terminal of the resistive voltage dividing device $\mathbf{404}_1$ connected to ground and a terminal of the resistive voltage dividing device $\mathbf{404}_{N+1}$ connected to the output voltage $V_{out}$; and a group of trimming units $\Delta_1$~$\Delta_N$ configured to provide the plurality of feedback terminals $FB_1$~$FB_N$, wherein the trimming unit $\Delta_X$ is coupled between the resistive voltage dividing devices $\mathbf{404}_X$ and $\mathbf{404}_{X+1}$, and wherein the trimming unit $\Delta_X$ is configured to provide the feedback terminal $FB_X$ at a predetermined leading out position on the trimming unit $\Delta_X$ before trimming; and wherein the trimming unit $\Delta_X$ is further configured to trim the leading out position of the feedback terminal $FB_X$ on the trimming unit $\Delta_X$ so as to trim the feedback voltage $V_{fb(X)}$ such that the corresponding output value $V_{out(X)}$ could be trimmed to its desired value; and wherein X changes from 1 to N successively. In this case, the output values $V_{out(1)\sim Vout(N)}$ may be successively trimmed to their desired values by successively trimming the leading out positions of the feedback terminals $FB_1$~$FB_N$ on the trimming units $\Delta_1$~$\Delta_N$.

In one embodiment, the resistive voltage dividing device $\mathbf{404}_X$ has an equivalent resistance identified by $R_X$; and the trimming unit $\Delta_X$ has an equivalent resistance identified by $\Delta R_X$. For the simplicity of explanation, in an exemplary embodiment, the predetermined leading out position of the feedback terminal $FB_X$ before trimming is at the middle of the trimming unit $\Delta_X$. Thus, the output values $V_{out(1)}$~$V_{out(N)}$ may be expressed by the following equations:

$$V_{out(X)} = \frac{R_{total} \times Vref}{R'_X + R'_{X-1} + \ldots + R'_1} \quad (X = 1, \ldots, N) \tag{5}$$

wherein:

$$R_{total} = \sum_{X=1}^{X=N} (R_X + \Delta R_X) + R_{N+1} \tag{6}$$

$$R'_X = R_X + \frac{1}{2}\Delta R_{X-1} + \frac{1}{2}\Delta R_X \quad (X = 2, \ldots, N) \tag{7}$$

and $$R'_1 = R_1 + \frac{1}{2}\Delta R_1 \tag{8}$$

From the expressions (5)~(8), it can be seen that the output values $V_{out(1)}$~$V_{out(N)}$ may be successively trimmed by successively trimming the resistances $R'_1$~$R'_N$. In this way, supposing that the output value $V_{out(X)}$ has already been appropriately trimmed to its desired value via trimming the resistance $R'_X$, the output value $V_{out(X+1)}$ may be trimmed via trimming the resistance $R'_{X+1}$ without influencing the already appropriately trimmed output value $V_{out(X)}$, wherein X may change from 1 to N. That is to say, the output values $V_{out(1)}$~$V_{out(N)}$ could be successively trimmed to their desired values independently via successively trimming the resistances $R'_1$~$R'_N$. In the meanwhile, the resistances $R'_1$~$R'_N$ could be successively trimmed via successively trimming the leading out positions of the feedback terminals $FB_1$~$FB_N$ on the trimming units $\Delta_1$~$\Delta_N$. Thus, the output values $V_{out(1)}$~$V_{out(N)}$ could be successively trimmed to their desired values independently via successively trimming the leading out positions of the feedback terminals $FB_1$~$FB_N$ on the trimming units $\Delta_1$~$\Delta_N$.

In accordance with one embodiment of the present invention, the trimming unit $\Delta_X$ is configured to trim the output value $V_{out(X)}$ in a trimming range related to the ratio between $\Delta R_X$ and $R_X$. In one embodiment, the trimming unit $\Delta_X$ may have a trimming range of $$\left[-\frac{\Delta R_X}{2}, \frac{\Delta R_X}{2}\right]$$

to the resistance $R'_X$, that is to say, the trimming unit $\Delta_X$ may trim the resistance $R'_X$ to have a change (an increase or a decrease) lying in $$\left[-\frac{\Delta R_X}{2}, \frac{\Delta R_X}{2}\right].$$

Thus, the trimming range of the trimming unit $\Delta_X$ to the output value $V_{out(X)}$ may be:

$$-\frac{\Delta R_X}{2R_X} \le \frac{V'_{out(X)} - V_{out(X)}}{V_{out(X)}} \le \frac{\Delta R_X}{2R_X} \quad (X = 1, \ldots, N) \tag{9}$$

wherein the label $V'_{out(X)}$ represents a trimmed value of the output value $V_{out(X)}$ that could be achieved after trimming.

In accordance with one embodiment of the present invention, the trimming unit $\Delta_X$ is configured to trim the output value $V_{out(X)}$ with a predetermined trimming step. In one embodiment, the trimming unit $\Delta_X$ is configured to trim the resistance $R'_X$ with a predetermined trimming step $$\frac{\Delta R_X}{(2^M + 2^{M+1} + \ldots + 2^0)},$$

thus, the trimming unit $\Delta_X$ could correspondingly trim the output value $V_{out(X)}$ with a predetermined trimming step $$\frac{1}{(2^M + 2^{M-1} + \ldots + 2^0)} \cdot \frac{\Delta R_X}{R_X},$$

wherein M is a non-negative integer.

Figure 5:
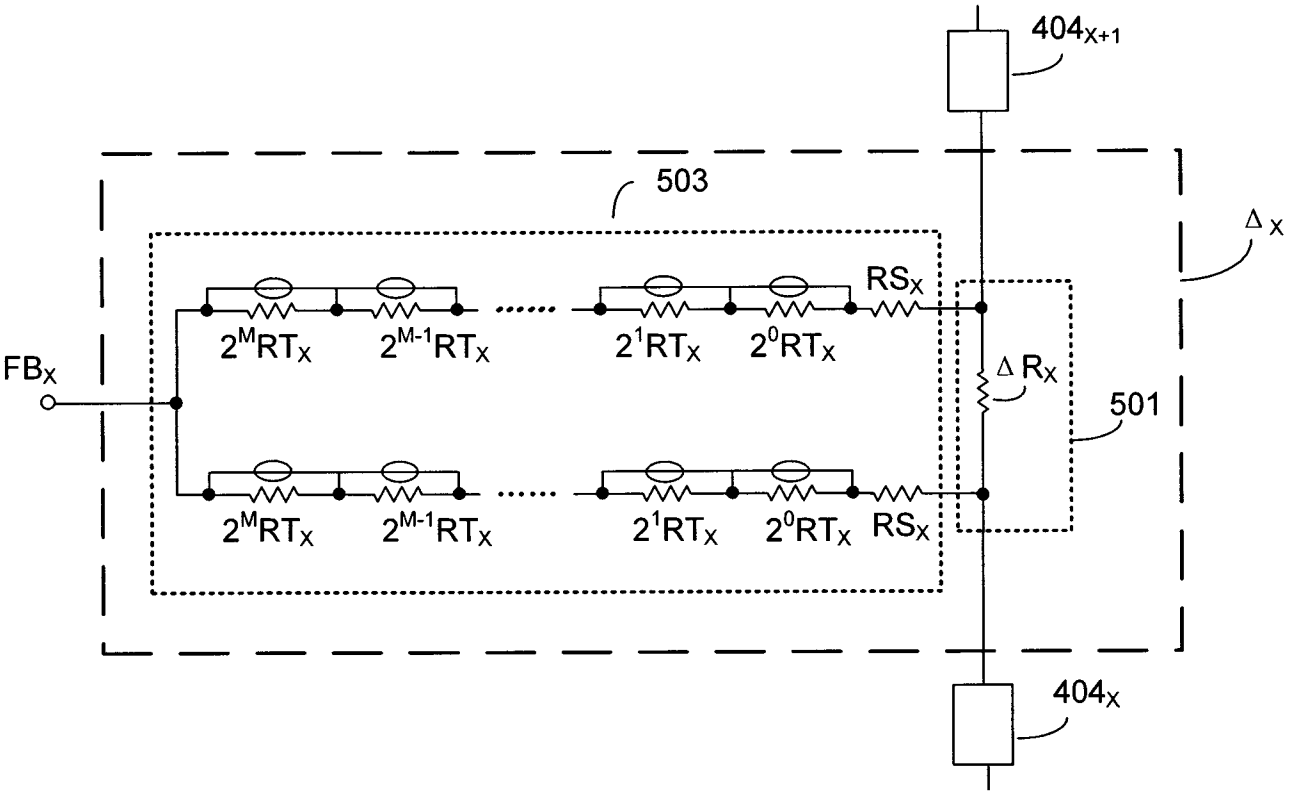
FIG. 5 illustrates schematically a trimming unit of the voltage regulator 400 in accordance with one embodiment of the present invention.

FIG. 5 illustrates schematically a trimming unit $\Delta_X$ in accordance with one embodiment of the present invention. The trimming unit $\Delta_X$ may comprise: a first trimming branch 501 having a first terminal coupled to the resistive voltage dividing device $\mathbf{404}_X$ and a second terminal coupled to the resistive voltage dividing device $\mathbf{404}_{X+1}$, wherein the first trimming branch 501 may have a resistance identified by $\Delta R_X$; and a second trimming branch 503 comprising a first group of M+1 series coupled trimming resistors having a first terminal coupled to the feedback terminal $FB_X$, and a second terminal coupled to the first terminal of the first trimming branch 501 via a resistor identified by $RS_X$, wherein the first group of M+1 trimming resistors respectively have the resistances successively identified by $2^M RT_X$, $2^{M-1} RT_X$, . . . , $2^0 RT_X$; a second group of M+1 series coupled trimming resistors having a first terminal coupled to the feedback terminal $FB_X$, and a second terminal coupled to the second terminal of the first trimming branch 501 via a resistor identified by $RS_X$, wherein the second group of M+1 trimming resistors respectively have the resistances successively identified by $2^M RT_X$, $2^{M-1} RT_X$, . . . , $2^0 RT_X$; and 2(M+1) trimming fuses correspondingly coupled in parallel with each of the trimming resistors; wherein M is a non-negative integer; and wherein M, M−1, . . . , 0 are the trimming weighted index numbers for the M+1 series coupled trimming resistors respectively having the resistances successively identified by $2^M RT_X$, $2^{M-1} RT_X$, . . . , $2^0 RT_X$. In such configuration, the feedback terminal $FB_X$ has a predetermined leading out position at the middle of the second trimming branch 503.

In one embodiment, the first trimming branch 501 may comprise a resistor having the resistance identified by $\Delta R_X$.

In one embodiment, the resistance identified by $\Delta R_X$ of the first trimming branch 501 is much smaller than each of the resistances identified by $2^M RT_X$, $2^{M-1} RT_X$, . . . , $2^0 RT_X$, and $RS_X$. Furthermore, the resistance identified by $RS_X$ is much smaller than the total resistance of the M+1 series coupled trimming resistors identified by $(2^M+2^{M-1}+ \ldots +2^0)RT_X$. Thus, the trimming unit $\Delta_X$ has an equivalent resistance substantially equal to the resistance identified by $\Delta R_X$ and substantially constant during trimming, which ensures the resistance coupled between the output voltage $V_{out}$ and ground, i.e., the resistance identified by $R_{total}$ in the expression (6), substantially invariant during trimming. In addition, the variation of the leading out position of the feedback terminal $FB_X$ on the second trimming branch 503 may be viewed as that the feedback terminal $FB_X$ is sliding on the first trimming branch 501, changing the contribution of $\Delta R_X$ to the resistance $R'_X$ expressed by (7). In this way, the trimming unit $\Delta_X$ could be configured to trim the resistance $R'_X$ via varying the leading out position of the feedback terminal $FB_X$ on the second trimming branch 503, realizing the trimming to the output value $V_{out(X)}$.

In one embodiment, the trimming unit $\Delta_X$ is configured to vary the leading out position of the feedback terminal $FB_X$ on the second trimming branch 503 via selectively cutting off a plurality of trimming fuses coupled to a selected plurality of trimming resistors among the first group of M+1 trimming resistors and the second group of M+1 trimming resistors. In one embodiment, the trimming unit $\Delta_X$ is configured to vary the leading out position of the feedback terminal $FB_X$ on the second trimming branch 503 via selectively cutting off a first plurality of trimming fuses coupled to a first plurality of selected trimming resistors among the first group of M+1 trimming resistors, and a second plurality of trimming fuses coupled to a second plurality of selected trimming resistors among the second group of M+1 trimming resistors, wherein the trimming weighted index numbers of the first plurality of selected trimming resistors and the trimming weighted index numbers of the second plurality of selected trimming resistors are complementary such that the total resistance contributed to the second trimming branch 503 by the first group of M+1 trimming resistors and the second group of M+1 trimming resistors maintains at a resistance identified by $(2^M+2^{M-1}+ \ldots +2^0)RT_X$ during trimming.

In the context of the present disclosure, the trimming weighted index numbers of the first plurality of selected trimming resistors and the trimming weighted index numbers of the second plurality of selected trimming resistors are complementary means that if the trimming weighted index numbers of the first plurality of selected trimming resistors comprise a first plurality of index numbers among the trimming weighted index numbers M, M−1, . . . , 0, then the trimming weighted index numbers of the second plurality of selected trimming resistors comprise the rest of the index numbers among the trimming weighted index numbers M, M−1, . . . , 0, except the first plurality of index numbers. For instance, in one embodiment, if the trimming weighted index numbers of the first selected plurality of trimming resistors comprise 0, then the trimming weighted index numbers of the second selected plurality of trimming resistors comprise M, M−1, . . . , 1, except 0. In this case, the trimming unit $\Delta_X$ is configured to cut off the trimming fuse coupled to the trimming resistor having the resistance identified by $2^0 RT_X$ among the first group of M+1 trimming resistors, and complementarily cut off the trimming fuses coupled to the trimming resistors having the resistances respectively identified by $2^M$ $RT_X$, $2^{M-1}$ $RT_X$, . . . , $RT_X$ among the second group of M+1 trimming resistors, resulting in the leading out position of the feedback terminal $FB_X$ sliding from $$\frac{1}{2}\Delta R_X \text{ to } \frac{2^0}{2^M + 2^{M-1} + \ldots + 2^0}\Delta R_X$$

on the first trimming branch 501. And thus, the resistance $R'_X$ defined by the expression (7) is increased by $$\left(\frac{1}{2} - \frac{2^0}{2^M + 2^{M-1} + \ldots + 2^0}\right)\Delta R_X,$$

resulting in the output value $V_{out(X)}$ expressed by the equation (7) decreased. Those skilled in the art should understand that in other embodiments, the first plurality of index numbers could be freely chosen among the trimming weighted index numbers M, M−1, . . . , 0 according to practical application needs, then the second plurality of index numbers are chosen to be complementary to the first plurality of index numbers, i.e., the second plurality of index numbers comprise the rest of the index numbers among the trimming weighted index numbers M, M−1, . . . , 0, except the first plurality of index numbers. The possible complementary combination of the first plurality of index numbers and the second plurality of index numbers will not be all listed herein.

In the exemplary embodiment shown in FIG. 5, the trimming unit $\Delta_X$ could be configured to trim the resistance $R'_X$ in a trimming range of $$\left[-\frac{\Delta R_X}{2}, \frac{\Delta R_X}{2}\right]$$

with a predetermined trimming step $$\frac{\Delta R_X}{(2^M + 2^{M-1} + \ldots + 2^0)},$$

thus, correspondingly the trimming unit $\Delta_X$ could achieve a trimming range of $$\left[-\frac{\Delta R_X}{2R_X}, \frac{\Delta R_X}{2R_X}\right]$$

to the output value $V_{out(X)}$ as defined by the expression (9) with a predetermined trimming step $$\frac{1}{(2^M + 2^{M-1} + \ldots + 2^0)} \cdot \frac{\Delta R_X}{R_X}.$$

Figure 6:
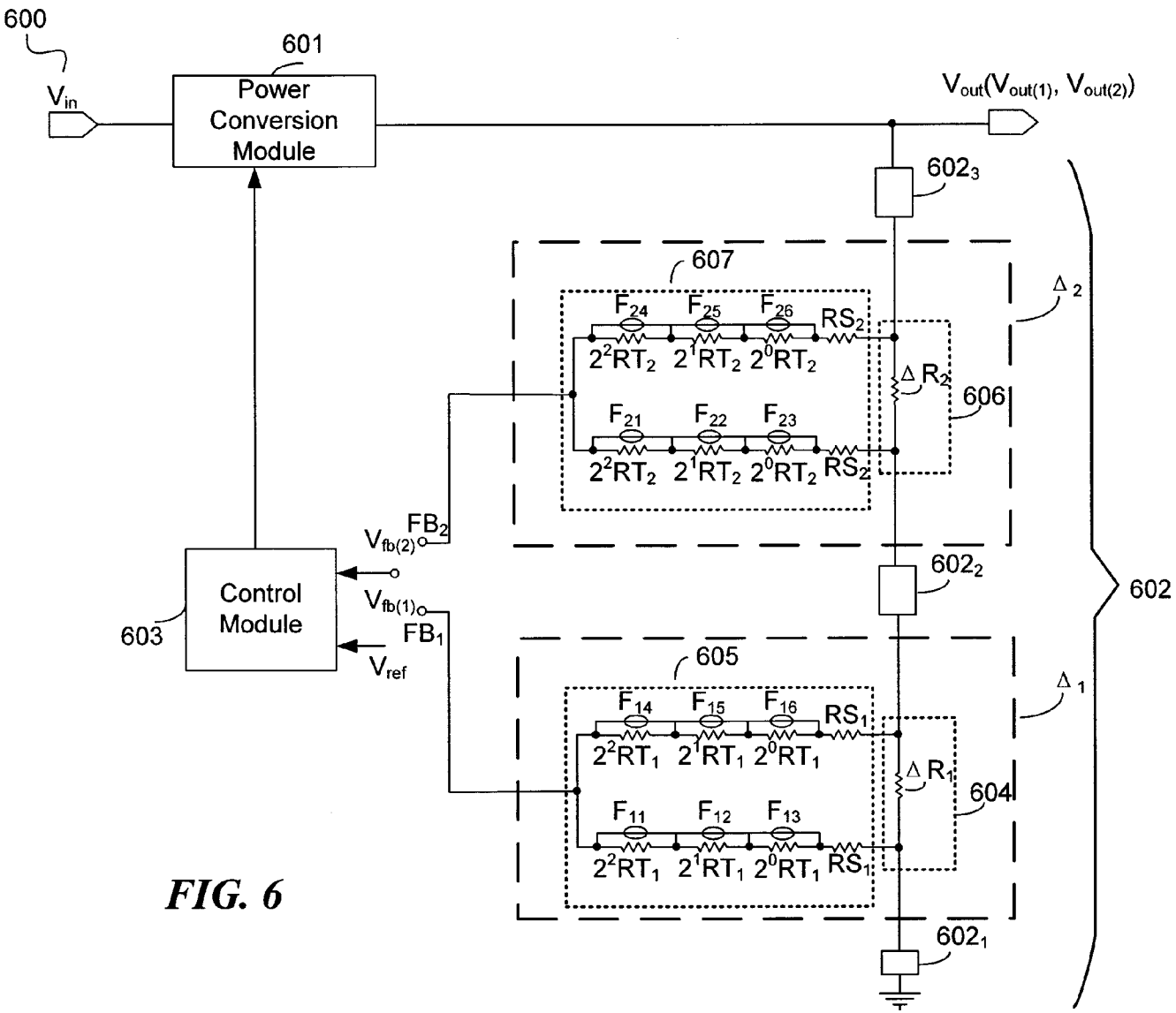
FIG. 6 illustrates schematically a voltage regulator 600 capable of providing an output voltage having two different regulated output values in accordance with one embodiment of the present invention.

FIG. 6 illustrates schematically an exemplary voltage regulator 600 configurable to provide an output voltage $V_{out}$ having two output values $V_{out(1)}$ and $V_{out(2)}$ in accordance with one embodiment of the present invention to help better understand the present invention. The voltage regulator 600 comprises: a power conversion module 601 configured to receive an input voltage $V_{in}$, and to convert the input voltage $V_{in}$ into an output voltage $V_{out}$ configurable to be regulated to two output values $V_{out(1)}$ and $V_{out(2)}$; a feedback and trimming module 602 configured to provide two feedback terminals $FB_1$ and $FB_2$ respectively providing two feedback voltages $V_{f1(1)}$ and $V_{fb(2)}$ corresponding to the output values $V_{out(1)}$ and $V_{out(2)}$; and a control module 603 configured to selectively receive one of the two feedback voltages $V_{fb(1)}$ and $V_{fb(2)}$, and to compare the received feedback voltage $V_{fb(1)}$ or $V_{fb(2)}$ with a reference signal $V_{ref}$ to provide a control signal to the power conversion module 601, wherein the control signal represents an error between the received feedback voltage $V_{fb(1)}$ (or $V_{fb(2)}$) and the reference signal $V_{ref}$, and wherein the power conversion module 601 regulates the output voltage $V_{out}$ to the output value $V_{out(1)}$ (or $V_{out(2)}$) in response to the control signal.

In one embodiment, as illustrated in FIG. 6, the feedback and trimming module 602 may comprise a group of resistive voltage dividing devices $\mathbf{602}_1$~$\mathbf{602}_3$ coupled in series between the output voltage $V_{out}$ and ground with a terminal of the resistive voltage dividing device $\mathbf{602}_1$ connected to ground and a terminal of the resistive voltage dividing device $\mathbf{602}_3$ connected to the output voltage $V_{out}$; and a group of trimming units $\Delta_1$~$\Delta_2$ configured to provide the feedback terminals $FB_1$~$FB_2$, wherein the trimming unit $\Delta_1$ is coupled between the resistive voltage dividing devices $\mathbf{602}_1$ and $\mathbf{602}_2$, and is configured to provide the feedback terminal $FB_1$ at the middle of the trimming unit $\Delta_1$ before trimming; and wherein the trimming unit $\Delta_2$ is coupled between the resistive voltage dividing devices $\mathbf{602}_2$ and $\mathbf{602}_3$, and is configured to provide the feedback terminal $FB_2$ at the middle of the trimming unit $\Delta_2$ before trimming; and wherein the trimming units $\Delta_1$ and $\Delta_2$ are further configured to successively trim the leading out positions of the feedback terminals $FB_1$ and $FB_2$ respectively on the trimming units $\Delta_1$ and $\Delta_2$ so as to trim the feedback voltages $V_{fb(1)}$ and $V_{fb(2)}$ successively, such that the output values $V_{out(1)}$) and $V_{out(2)}$ could be successively trimmed to their desired values.

In the embodiment shown in FIG. 6, the output values $V_{out(1)}$ and $V_{out(2)}$ may be expressed as follows before trimming:

$$V_{out(1)} = \frac{R_{total} \times Vref}{R'_1} \tag{10}$$

$$V_{out(2)} = \frac{R_{total} \times Vref}{R'_2 + R'_1} \tag{11}$$

$$\text{wherein } R_{total} = R_1 + \Delta R_1 + R_2 + \Delta R_2 + R3,\ R'_1 = R_1 + \frac{1}{2}\Delta R_1,$$

$$\text{and } R'_2 = R_2 + \frac{1}{2}\Delta R_1 + \frac{1}{2}\Delta R_2.$$

Continuing with FIG. 6, the trimming unit $\Delta_1$ is illustrated to comprise a first trimming branch 604 having a first terminal coupled to the resistive voltage dividing device $\mathbf{602}_1$ and a second terminal coupled to the resistive voltage dividing device $\mathbf{602}_2$, wherein the first trimming branch 604 may have a resistance identified by $\Delta R_1$; and a second trimming branch 605 comprising a first group of 3 series coupled trimming resistors having a first terminal coupled to the feedback terminal $FB_1$, and a second terminal coupled to the first terminal of the first trimming branch 604 via a resistor identified by $RS_1$, wherein the first group of 3 trimming resistors respectively have the resistances successively identified by $2^2$ $RT_1$, $2^1$ $RT_1$, and $2^0$ $RT_1$; a second group of 3 series coupled trimming resistors having a first terminal coupled to the feedback terminal $FB_1$, and a second terminal coupled to the second terminal of the first trimming branch 604 via a resistor identified by $RS_1$, wherein the second group of 3 trimming resistors respectively have the resistances successively identified by $2^2 RT_1$, $2^1 RT_1$, and $2^0 RT_1$; and 6 trimming fuses $F_{11}$, $F_{12}$, $F_{13}$, $F_{14}$, $F_{15}$, and $F_{16}$, wherein the trimming fuses $F_{11}$, $F_{12}$, and $F_{13}$ are respectively coupled in parallel with the first group of trimming resistors identified by $2^2 RT_1$, $2^1 RT_1$, and $2^0 RT_1$, and wherein the trimming fuses $F_{14}$, $F_{15}$, and $F_{16}$ are respectively coupled in parallel with the second group of trimming resistors identified by $2^2 RT_1$, $2^1 RT_1$, and $2^0 RT_1$; and wherein 2, 1, and 0 are the trimming weighted index numbers for the trimming resistors respectively having the resistances successively identified by $2^2 RT_1$, $2^1 RT_1$, and $2^0 RT_1$. In such configuration, the feedback terminal $FB_1$ has a predetermined leading out position at the middle of the second trimming branch 605.

Similarly, the trimming unit $\Delta_2$ is illustrated to comprise a first trimming branch 606 having a first terminal coupled to the resistive voltage dividing device $\mathbf{602}_2$ and a second terminal coupled to the resistive voltage dividing device $\mathbf{602}_3$, wherein the first trimming branch 606 may have a resistance identified by $\Delta R_2$; and a second trimming branch 607 comprising a third group of 3 series coupled trimming resistors having a first terminal coupled to the feedback terminal $FB_2$, and a second terminal coupled to the first terminal of the first trimming branch 606 via a resistor identified by $RS_2$, wherein the third group of 3 trimming resistors respectively have the resistances successively identified by $2^2 RT_2$, $2^1 RT_2$, and $2^0 RT_2$; a fourth group of 3 series coupled trimming resistors having a first terminal coupled to the feedback terminal $FB_2$, and a second terminal coupled to the second terminal of the first trimming branch 606 via a resistor identified by $RS_2$, wherein the fourth group of 3 trimming resistors respectively have the resistances successively identified by $2^2 RT_2$, $2^1 RT_Z$, and $2^0 RT_2$; and 6 trimming fuses $F_{21}$, $F_{22}$, $F_{23}$, $F_{24}$, $F_{25}$, and $F_{26}$, wherein the trimming fuses $F_{21}$, $F_{22}$, and $F_{23}$ are respectively coupled in parallel with the third group of trimming resistors identified by $2^2 RT_2$, $2^1 RT_2$, and $2^0 RT_2$, and wherein the trimming fuses $F_{24}$, $F_{25}$, and $F_{26}$ are respectively coupled in parallel with the second group of trimming resistors identified by $2^2 RT_2$, $2^1 RT_2$, and $2^0 RT_2$; and wherein 2, 1, and 0 are the trimming weighted index numbers for the trimming resistors respectively having the resistances successively identified by $2^2 RT_2$, $2^1 RT_2$, and $2^0 RT_2$. In such configuration, the feedback terminal $FB_2$ has a predetermined leading out position at the middle of the second trimming branch 607.

In the embodiment illustrated in FIG. 6, the resistance identified by $\Delta R_1$ of the first trimming branch 604 of the trimming unit $\Delta_1$ is much smaller than each of the resistances identified by $2^2 RT_1$, $2^1 RT_1$, $2^0 RT_1$, and $RS_1$, and the resistance identified by $RS_1$ is much smaller than the total resistance of the first/second group of series coupled trimming resistors identified by $(2^2+2^1+2^0)RT_1$. Furthermore, the resistance identified by $\Delta R_2$ of the first trimming branch 606 of the trimming unit $\Delta_2$ is much smaller than each of the resistances identified by $2^2 RT_2$, $2^1 RT_2$, $2^0 RT_2$, and $RS_2$, and the resistance identified by $RS_2$ is much smaller than the total resistance of the third/fourth group of series coupled trimming resistors identified by $(2^2+2^1+2^0)RT_2$. Thus, the trimming unit $\Delta A_1$ has an equivalent resistance substantially equal to the resistance identified by $\Delta R_1$ and substantially constant during trimming; the trimming unit $\Delta_2$ has an equivalent resistance substantially equal to the resistance identified by $\Delta R_2$ and substantially constant during trimming.

When the output values $V_{out(1)}$) and $V_{out(2)}$ in the exemplary embodiment shown in FIG. 6 are deviated from their desired values, the feedback and trimming module 602 may be configured to successively trim the leading out positions of the feedback terminals $FB_1$ and $FB_2$ so as to trim the output values $V_{out(1)}$) and $V_{out(2)}$ successively and independently.

Firstly, the trimming unit $\Delta_1$ is configured to trim the leading out position of the feedback terminal $FB_1$ on the first trimming branch 604 so as to trim the output value $V_{out(1)}$. In one embodiment, the trimming unit $\Delta_1$ is configured to selectively cut off a plurality of trimming fuses among the trimming fuses $F_{11}$, $F_{12}$, $F_{13}$, $F_{14}$, $F_{15}$, and $F_{16}$ to trim the leading out position of the feedback terminal $FB_1$ on the first trimming branch 604, wherein the trimming weighted index numbers corresponding to the trimming fuses that are cut off among the trimming fuses $F_{11}$, $F_{12}$, and $F_{13}$, and the trimming weighted index numbers corresponding to the trimming fuses that are cut off among the trimming fuses $F_{14}$, $F_{15}$, and $F_{16}$ are complementary such that the total resistance contributed to the second trimming branch 605 by the first group of trimming resistors and the second group of trimming resistors maintains at a resistance identified by $(2^2+2^1+2^0)RT_1$ during trimming. The following table (T1) lists all the possible ways of cutting off a plurality of trimming fuses among the trimming fuses $F_{11}$, $F_{12}$, $F_{13}$, $F_{14}$, $F_{15}$, and $F_{16}$ to trim the output value $V_{out(1)}$, wherein $\Delta V_{out(1)}=V'_{out(1)}-V_{out(1)}$, and wherein $V'_{out(1)}$ is the trimmed value of the output value $V_{out(1)}$ that could be achieved after trimming, and wherein the symbol X represents cut off.

(T1)

| $F_{11}$ | $F_{12}$ | $F_{13}$ | $F_{14}$ | $F_{15}$ | $F_{16}$ | $\Delta V_{out(1)}/V_{out(1)}$ |
|---|---|---|---|---|---|---|
| X | X | X | | | | $-3.5\Delta R_1/7R_1$ |
| X | X | | | | X | $-2.5\Delta R_1/7R_1$ |
| X | | X | | X | | $-1.5\Delta R_1/7R_1$ |
| X | | | | X | X | $-0.5\Delta R_1/7R_1$ |
| | X | X | X | | | $0.5\Delta R_1/7R_1$ |
| | X | | X | | X | $1.5\Delta R_1/7R_1$ |
| | | X | X | X | | $2.5\Delta R_1/7R_1$ |
| | | | X | X | X | $3.5\Delta R_1/7R_1$ |

The trimming unit $\Delta_1$ could achieve a trimming range of $$\left[-\frac{1}{2}\Delta R_1, \frac{1}{2}\Delta R_1\right]$$

to the resistance identified by $R'_1$ with a trimming step of $$\frac{1}{2^2+2^1+2^0}\Delta R_1.$$

Thus, correspondingly, the trimming unit $\Delta_1$ could achieve a trimming range of $$\left[-\frac{\Delta R_1}{2R_1}, \frac{\Delta R_1}{2R_1}\right]$$

to the output value $V_{out(1)}$ with a trimming step of $$\frac{1}{2^2+2^1+2^0}\cdot\frac{\Delta R_1}{R_1},$$

as can be seen from table (T1).

After the output value $V_{out(1)}$) is trimmed, the trimming unit $\Delta_2$ is configured to trim the leading out position of the feedback terminal $FB_2$ on the first trimming branch 606 so as to trim the output value $V_{out(2)}$. In one embodiment, the trimming unit $\Delta_2$ is configured to selectively cut off a plurality of trimming fuses among the trimming fuses $F_{21}$, $F_{22}$, $F_{23}$, $F_{24}$, $F_{25}$, and $F_{26}$ to trim the leading out position of the feedback terminal $FB_2$ on the first trimming branch 606, wherein the trimming weighted index numbers corresponding to the trimming fuses that are cut off among the trimming fuses $F_{21}$, $F_{22}$, and $F_{23}$, and the trimming weighted index numbers corresponding to the trimming fuses that are cut off among the trimming fuses $F_{14}$, $F_{15}$, and $F_{16}$ are complementary such that the total resistance contributed to the second trimming branch 607 by the third group of trimming resistors and the fourth group of trimming resistors maintains at a resistance identified by $(2^2+2^1+2^0)RT_2$ during trimming. The following table (T2) lists all the possible ways of cutting off a plurality of trimming fuses among the trimming fuses $F_{21}$, $F_{22}$, $F_{23}$, $F_{24}$, $F_{25}$, and $F_{26}$ to trim the output value $V_{out(2)}$, wherein $\Delta V_{out(2)}=V'_{out(2)}-V_{out(2)}$, and wherein $V'_{out(2)}$ is the trimmed value of the output value $V_{out(2)}$ that could be achieved after trimming, and wherein the symbol X represents cut off.

(T2)

| $F_{21}$ | $F_{22}$ | $F_{23}$ | $F_{24}$ | $F_{25}$ | $F_{26}$ | $\Delta V_{out(2)}/V_{out(2)}$ |
|---|---|---|---|---|---|---|
| X | X | X | | | | $-3.5\Delta R_2/7R_2$ |
| X | X | | | | X | $-2.5\Delta R_2/7R_2$ |
| X | | X | | X | | $-1.5\Delta R_2/7R_2$ |
| X | | | | X | X | $-0.5\Delta R_2/7R_2$ |
| | X | X | X | | | $0.5\Delta R_2/7R_2$ |
| | X | | X | | X | $1.5\Delta R_2/7R_2$ |
| | | X | X | X | | $2.5\Delta R_2/7R_2$ |
| | | | X | X | X | $3.5\Delta R_2/7R_2$ |

The trimming unit $\Delta_2$ could achieve a trimming range of $$\left[-\frac{1}{2}\Delta R_2, \frac{1}{2}\Delta R_2\right]$$

to the resistance identified by $R'_2$ with a trimming step of $$\frac{1}{2^2+2^1+2^0}\Delta R_2.$$

Thus, correspondingly, the trimming unit $\Delta_2$ could achieve a trimming range of $$\left[-\frac{\Delta R_2}{2R_2}, \frac{\Delta R_2}{2R_2}\right]$$

to the output value $V_{out(2)}$ with a trimming step of $$\frac{1}{2^2+2^1+2^0}\cdot\frac{\Delta R_2}{R_2},$$

as can be seen from table (T2).

Various voltage regulators comprising trimming circuits in accordance with various embodiments of the present invention are described with reference to FIGS. 4 to 6. The voltage regulators in accordance with various embodiments of the present invention may be able to provide an output voltage configurable to be regulated to a plurality of output values. When the plurality of output values are deviated from their desired values, the trimming circuits in accordance with various embodiments of the present invention may be able to trim the plurality of output values successively to their desired values, and the trimming for two successive output values are independent. The trimming circuits may utilize a plurality of series coupled voltage dividing devices to provide a plurality of feedback voltages correspondingly related to the plurality of output values, the plurality of feedback voltages are provided at a plurality of feedback terminals led out from a plurality of different positions on the plurality of series coupled voltage dividing devices, and the trimming circuits are configured to trim the plurality of output values by trimming the plurality of leading out positions of the plurality of feedback terminals. Besides, the trimming range and the trimming step to each output value could be set according to practical application requirements. Thus, the output values may be trimmed to their desired values with good precision while reduced power loss and reduced chip size could be expected. This advantage may become more obvious when more than two output values are desired to be provided by the voltage regulators. The trimming circuits in accordance with various embodiments of the present invention have good compatibility may be applied to various types of voltage regulators to provide trimming for the output voltages of the voltage regulators.

Figure 7:
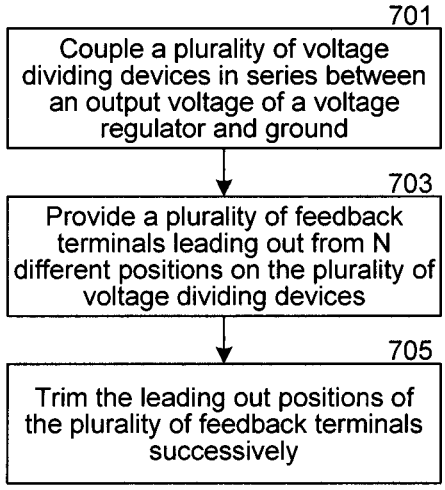
FIG. 7 illustrates a flow chart of a method for trimming an output voltage of a voltage regulator in accordance with one embodiment of the present invention.

FIG. 7 illustrates a flow chart of a method for trimming an output voltage of a voltage regulator. The trimming method comprises: step 701, coupling a plurality of voltage dividing devices in series between the output voltage of the voltage regulator and ground; step 702, providing a plurality of feedback terminals indexed from 1 to N leading out from N different positions on the plurality of voltage dividing devices, wherein N is a positive integer, and wherein the plurality of feedback terminals having a plurality of feedback voltages indexed from 1 to N respectively corresponding to a plurality of output values indexed from 1 to N of the output voltage; and step 703, trimming the leading out positions of the plurality of feedback terminals indexed from 1 to N on the plurality of voltage dividing devices successively so as to trim the plurality of output values indexed from 1 to N successively and independently.

In one embodiment, the plurality of voltage dividing devices may comprise a group of resistive voltage dividing devices indexed from 1 to N+1, and a group of trimming units indexed from 1 to N. In this circumstance, the step 701 may comprise: coupling the group of resistive voltage dividing devices indexed from 1 to N+1 in series between the output voltage and ground with a terminal of the resistive voltage dividing device indexed by 1 connected to ground and a terminal of the resistive voltage dividing device indexed by N+1 connected to the output voltage; and coupling the trimming unit indexed by X between the resistive voltage dividing device indexed by X and the resistive voltage dividing device indexed by X+1; wherein X may change from 1 to N. The step 702 may comprise: providing the feedback terminal indexed by X at a predetermined leading out position on the trimming unit indexed by X before trimming, wherein X may change from 1 to N. And the step 703 may comprise: trimming the leading out positions of the plurality of feedback terminals indexed from 1 to N on the trimming units indexed from 1 to N respectively and successively so as to trim the plurality of output values indexed from 1 to N successively and independently.

From the foregoing, it will be appreciated that specific embodiments of the technology have been described herein for purposes of illustration, but that various modifications may be made without deviating from the disclosure. Many of the elements of one embodiment may be combined with other embodiments in addition to or in lieu of the elements of the other embodiments. Accordingly, the disclosure is not limited except as by the appended claims.

We claim:

1. A voltage regulator comprising:

a power conversion module configured to receive an input voltage, and to convert the input voltage into an output voltage configurable to be regulated to a plurality of output values indexed from 1 to N, wherein N is a positive integer;

a feedback and trimming module comprising a plurality of voltage dividing devices coupled in series between the output voltage and ground, wherein the feedback and trimming module is configured to provide a plurality of feedback terminals indexed from 1 to N leading out from N different positions on the plurality of voltage dividing devices, and wherein the plurality of feedback terminals indexed from 1 to N are configured to provide a plurality of feedback voltages indexed from 1 to N respectively corresponding to the plurality of output values indexed from 1 to N; and a control module configured to selectively receive one of the plurality of feedback voltages indexed by X a time, and to compare the received feedback voltage indexed by X with a reference signal to provide a control signal to the power conversion module, wherein the control signal represents an error between the received feedback voltage indexed by X and the reference signal, and wherein the power conversion module regulates the output voltage to the output value indexed by X corresponding to the received feedback voltage indexed by X in response to the control signal, and wherein X changes from 1 to N; and wherein the feedback and trimming module is further configured to successively trim the leading out positions of the plurality of feedback terminals indexed from 1 to N on the plurality of voltage dividing devices so as to successively trim the plurality of output values indexed from 1 to N to their desired values independently.

2. The voltage regulator of claim 1, wherein the feedback and trimming module comprises:

a group of resistive voltage dividing devices indexed from 1 to N+1 coupled in series between the output voltage and ground with a terminal of the resistive voltage dividing device indexed by 1 connected to ground and a terminal of the resistive voltage dividing device indexed by N+1 connected to the output voltage; and a group of trimming units indexed from 1 to N configured to provide the plurality of feedback terminals indexed from 1 to N, wherein the trimming unit indexed by X is coupled between the resistive voltage dividing device indexed by X and the resistive voltage dividing device indexed by X+1, and wherein the trimming unit indexed by X is configured to provide the feedback terminal indexed by X at a predetermined leading out position before trimming, and wherein the trimming unit indexed by X is further configured to trim the leading out position of the feedback terminal indexed by X on the trimming unit indexed by X so as to trim the output value indexed by X to its desired value, and wherein X successively changes from 1 to N.

3. The voltage regulator of claim 2, wherein the resistive voltage dividing device indexed by X has an equivalent resistance identified by $R_X$; and wherein the trimming unit indexed by X has an equivalent resistance identified by $\Delta R_X$; and wherein the trimming unit indexed by X is configured to trim the output value indexed by X in a trimming range related to the ratio between $\Delta R_X$ and $R_X$.

4. The voltage regulator of claim 2, wherein the trimming unit indexed by X is configured to trim the output value indexed by X with a predetermined trimming step.

5. The voltage regulator of claim 2, wherein the trimming unit indexed by X comprises:

a first trimming branch having a first terminal coupled to the resistive voltage dividing device indexed by X and a second terminal coupled to the resistive voltage dividing device indexed by X+1, wherein the first trimming branch has a resistance identified by $\Delta R_X$; and a second trimming branch comprising:

a first group of M+1 series coupled trimming resistors having a first terminal coupled to the feedback terminal indexed by X, and a second terminal coupled to the first terminal of the first trimming branch via a resistor identified by $RS_X$, wherein the first group of M+1 trimming resistors respectively have the resistances successively identified by $2^M RT_X, 2^{M-1} RT_X, \ldots, 2^0 RT_X$;

a second group of M+1 series coupled trimming resistors having a first terminal coupled to the feedback terminal indexed by X, and a second terminal coupled to the second terminal of the first trimming branch via a resistor identified by $RS_X$, wherein the second group of M+1 trimming resistors respectively have the resistances successively identified by $2^M RT_X, 2^{M-1} RT_X, \ldots, 2^0 RT_X$; and 2(M+1) trimming fuses correspondingly coupled in parallel with each of the trimming resistors; wherein M is a non-negative integer; and wherein M, M−1, . . . , 0 are the trimming weighted index numbers for the M+1 series coupled trimming resistors respectively having the resistances successively identified by $2^M RT_X, 2^{M-1} RT_X, \ldots, 2^0 RT_X$.

6. The voltage regulator of claim 5, wherein the resistive voltage dividing device indexed by X has an equivalent resistance identified by $R_X$; and wherein the trimming unit indexed by X has a trimming range of $$\left[-\frac{\Delta R_X}{2R_X}, \frac{\Delta R_X}{2R_X}\right]$$

to the output value indexed by X.

7. The voltage regulator of claim 5, wherein the resistive voltage dividing device indexed by X has an equivalent resistance identified by $R_X$; and wherein the trimming unit indexed by X has a predetermined trimming step of $$\frac{1}{(2^M + 2^{M-1} + \ldots + 2^0)} \cdot \frac{\Delta R_X}{R_X}$$

to the output value indexed by X.

8. The voltage regulator of claim 5, wherein the resistance identified by $\Delta R_X$, is much smaller than each of the resistances identified by $2^M RT_X$, $2^{M-1} RT_X$, . . . , $2^0 RT_X$, and $RS_X$, and wherein the resistance identified by $RS_X$ is much smaller than the total resistance of the M+1 series coupled trimming resistors identified by $(2^M+2^{M-1}+ \ldots +2^0)RT_X$.

9. The voltage regulator of claim 5, wherein the trimming unit indexed by X is configured to trim the leading out position of the feedback terminal indexed by X on the second trimming branch via selectively cutting off a plurality of trimming fuses coupled to a selected plurality of trimming resistors among the first group of M+1 trimming resistors and the second group of M+1 trimming resistors.

10. The voltage regulator of claim 5, wherein the trimming unit indexed by X is configured to trim the leading out position of the feedback terminal indexed by X on the second trimming branch via selectively cutting off a first plurality of trimming fuses coupled to a first plurality of selected trimming resistors among the first group of M+1 trimming resistors, and a second plurality of trimming fuses coupled to a second plurality of selected trimming resistors among the second group of M+1 trimming resistors, wherein the trimming weighted index numbers of the first plurality of selected trimming resistors and the trimming weighted index numbers of the second plurality of selected trimming resistors are complementary such that the total resistance contributed to the second trimming branch by the first group of M+1 trimming resistors and the second group of M+1 trimming resistors maintains at a resistance identified by $(2^M+2^{M-1}+ \ldots 2^0)RT_X$ during trimming.

11. A trimming circuit comprising: an input terminal configured to receive an output voltage of a voltage regulator configurable to be regulated to a plurality of output values indexed from 1 to N, wherein N is a positive integer; a plurality of feedback terminals indexed from 1 to N configured to provide a plurality of feedback voltages indexed from 1 to N corresponding to the plurality of output values indexed from 1 to N; and a plurality of voltage dividing devices coupled in series between the input terminal and ground, wherein the plurality of feedback terminals indexed from 1 to N are provided from N different leading out positions on the plurality of voltage dividing devices, and wherein the plurality of output values indexed from 1 to N corresponding to the plurality of feedback voltages indexed from 1 to N are successively and independently trimmed to their desired values via successively trimming the leading out positions of the plurality of feedback terminals indexed from 1 to N on the plurality of voltage dividing devices; wherein the plurality of voltage dividing devices comprises: a group of resistive voltage dividing devices indexed from 1 to N+1 coupled in series between the output voltage and ground with a terminal of the resistive voltage dividing device indexed by 1 connected to ground and a terminal of the resistive voltage dividing device indexed by N+1 connected to the output voltage; and a group of trimming units indexed from 1 to N configured to provide the plurality of feedback terminals indexed from 1 to N, wherein the trimming unit indexed by X is coupled between the resistive voltage dividing device indexed by X and the resistive voltage dividing device indexed by X+1, and wherein the trimming unit indexed by X is configured to provide the feedback terminal indexed by X at a predetermined leading out position before trimming, and wherein the trimming unit indexed by X is further configured to trim the leading out position of the feedback terminal indexed by X on the trimming unit indexed by X so as to trim the output value indexed by X to its desired value, and wherein X successively changes from 1 to N.

12. The trimming circuit of claim 11, wherein the resistive voltage dividing device indexed by X has an equivalent resistance identified by $R_X$; and wherein the trimming unit indexed by X has an equivalent resistance identified by $\Delta R_X$; and wherein the trimming for the output value indexed by X has a trimming range related to the ratio between $\Delta R_X$ and $R_X$.

13. The trimming circuit of claim 11, wherein the trimming for the output value indexed by X has a predetermined trimming step.

14. The trimming circuit of claim 11, wherein trimming unit indexed by X comprises:

a first trimming branch having a first terminal coupled to the resistive voltage dividing device indexed by X and a second terminal coupled to the resistive voltage dividing device indexed by X+1, wherein the first trimming branch comprises a resistor having a resistance identified by $\Delta R_X$; and a second trimming branch comprising:

a first group of M+1 series coupled trimming resistors having a first terminal coupled to the feedback terminal indexed by X, and a second terminal coupled to the first terminal of the first trimming branch via a resistor identified by $RS_X$, wherein the first group of M+1 trimming resistors respectively have the resistances successively identified by $2^M RT_X$, $2^{M-1} RT_X$, . . . , $2^0 RT_X$;

a second group of M+1 series coupled trimming resistors having a first terminal coupled to the $X^{th}$ feedback terminal, and a second terminal coupled to the second terminal of the first trimming branch via a resistor identified by $RS_X$, wherein the second group of M+1 trimming resistors respectively have the resistances successively identified by $2^M RT_X$, $2^{M-1} RT_X$, . . . , $2^0 RT_X$; and 2(M+1) trimming fuses correspondingly coupled in parallel with each of the trimming resistors; wherein M is a non-negative integer; and wherein M, M−1, . . . , 0 are the trimming weighted index numbers for the M+1 series coupled trimming resistors respectively having the resistances successively identified by $2^M RT_X$, $2^{M-1} RT_X$, . . . , $2^0 RT_X$.

15. The trimming circuit of claim 14, wherein the resistance identified by $\Delta R_X$ is much smaller than the resistances identified by $2^M RT_X$, $2^{M-1} RT_X$, . . . , $2^0 RT_X$, and $RS_X$, and wherein the resistance identified by $RS_X$ is much smaller than the total resistance of the M+1 series coupled trimming resistors identified by $(2^M+2^{M-1}+ \ldots 2^0)RT_X$.

16. The trimming circuit of claim 14, wherein the trimming unit indexed by X is configured to trim the leading out position of the feedback terminal indexed by X on the second trimming branch via selectively cutting off a plurality of trimming fuses coupled to a selected plurality of trimming resistors among the first group of M+1 trimming resistors and the second group of M+1 trimming resistors.

17. The trimming circuit of claim 14, wherein the trimming unit indexed by X is configured to trim the leading out position of the feedback terminal indexed by X on the second trimming branch via selectively cutting off a first plurality of trimming fuses coupled to a first plurality of selected trimming resistors among the first group of M+1 trimming resistors, and a second plurality of trimming fuses coupled to a second plurality of selected trimming resistors among the second group of M+1 trimming resistors, wherein the trimming weighted index numbers of the first plurality of selected trimming resistors and the trimming weighted index numbers of the second plurality of selected trimming resistors are complementary such that the total resistance contributed to the second trimming branch by the first group of M+1 trimming resistors and the second group of M+1 trimming resistors maintains at a resistance identified by $(2^M+2^{M-1}+\ldots 2^0)RT_X$ during trimming.

18. A method for trimming an output voltage of a voltage regulator comprising: coupling a plurality of voltage dividing devices in series between the output voltage and ground; providing a plurality of feedback terminals indexed from 1 to N leading out from N different positions on the plurality of voltage dividing devices, wherein N is a positive integer, and wherein the plurality of feedback terminals having a plurality of feedback voltages indexed from 1 to N respectively corresponding to a plurality of output values indexed from 1 to N of the output voltage; and trimming the leading out positions of the plurality of feedback terminals indexed from 1 to N on the plurality of voltage dividing devices successively so as to trim the plurality of output values indexed from 1 to N successively and independently; wherein the plurality of voltage dividing devices comprises a group of resistive voltage dividing devices indexed from 1 to N+1, and a group of trimming units indexed from 1 to N, and wherein the method further comprises: coupling the group of resistive voltage dividing devices indexed from 1 to N+1 in series between the output voltage and ground with a terminal of the resistive voltage dividing device indexed by 1 connected to ground and a terminal of the resistive voltage dividing device indexed by N+1 connected to the output voltage; coupling the trimming unit indexed by X between the resistive voltage dividing device indexed by X and the resistive voltage dividing device indexed by X+1, wherein X changes from 1 to N; providing the feedback terminal indexed by X at a predetermined leading out position on the trimming unit indexed by X before trimming, wherein X changes from 1 to N; and trimming the leading out positions of the plurality of feedback terminals indexed from 1 to N on the trimming units indexed from 1 to N respectively and successively so as to trim the plurality of output values indexed from 1 to N successively and independently.

* * * * *